US005180238A

United States Patent [19]

Hibino et al.

[11] Patent Number: 5,180,238

[45] Date of Patent: Jan. 19, 1993

[54] DOT IMPACT PRINTER

[75] Inventors: Hiromi Hibino; Kazumi Hasegawa, both of Tokyo; Koujiro Nishida, Coburg; Kouzou Abe, Tokyo; Toshio Kurihara, Tokorozawa, all of Japan

[73] Assignee: Citizen Watch Co., Ltd., Tokyo, Japan

[21] Appl. No.: 710,277

[22] Filed: Jun. 4, 1991

[30] Foreign Application Priority Data

Jun. 14, 1990 [JP] Japan ..... 2-157093

[51] Int. Cl.[5] ..... B41J 33/36

[52] U.S. Cl. ..... 400/247; 400/703

[58] Field of Search ..... 400/247, 249, 703, 712; 116/208, 278; 226/44, 45

[56] References Cited

U.S. PATENT DOCUMENTS 3,905,533 9/1975 Corse ..... 226/44
4,834,563 5/1989 Ozawa et al. ..... 400/703
4,852,480 8/1989 Kunita et al. ..... 101/93.05
5,016,182 5/1991 Bergland et al. ..... 226/44

*Primary Examiner*—Edgar S. Burr
*Assistant Examiner*—Anthony H. Nguyen
*Attorney, Agent, or Firm*—Koda and Androlia

[57] ABSTRACT

In a dot impact printer, printing heads impact on an inked ribbon so as to form a pattern of dots on a paper sheet. The more often printing is carried out, the looser the central portion of the inked ribbon becomes. A sensor disposed perpendicularly against a surface of the inked ribbon detects such a condition of the inked ribbon, emitting a signal. Receiving the signal, a control means finds the inked ribbon unusable, interrupting the printing operation, and knowing a timing to replace the inked ribbon. The control means operates an alarm to urge replacement of the inked ribbon. Therefore, the dot impact printer is prevented from performing the printing operation under unfavorable conditions.

2 Claims, 7 Drawing Sheets

DOT IMPACT PRINTER

BACKGROUND OF THE INVENTION

1. Field of the Invention

This invention relates to a dot impact printer in which printing operation is interrupted when an inked ribbon is found unusable.

2. Description of the Related Art

A dot impact printer is known in which characters or other symbols are formed by patterns of dots on a paper sheet. Any types of characters can be formed by combinations of dot patterns, so that the dot impact printers have been widely applied to data processing devices.

A narrow strip of inked cloth is used as an inked ribbon for such printers.

FIGS. 8(A) and 8(B) of the accompanying drawings are partial cross-sectional views showing a dot impact printer exemplified in U.S. Pat. No. 4,685,818. A ribbon sensor 10 is disposed on a ribbon guide 46 for guiding an inked ribbon 12 and having guide posts 16, 18. The ribbon sensor 10 includes a upper detector 10*a* and a lower detector 10*b* for detecting an upper edge 60 and a lower edge 62 of the inked ribbon 12.

The more frequently printing is performed, the more ink in the inked ribbon 12 is consumed, thereby making printed characters thinner and less distinct. The more often the printing pins impact the inked ribbon, the more the cloth of the inked ribbon would be crushed and become loose. As ink is consumed in the ribbon, the ribbon cloth becomes looser abruptly. In addition, the ribbon cloth is not always loosened uniformly in the direction of its width but becomes slack particularly at its central portion where printing is carried out. If printing is further continued, the central portion of the inked ribbon becomes loose, causing the ribbon to be folded in the feeding direction. The ribbon becomes narrower at its folded portions. Under such a condition, the ribbon cannot be fed normally, causing printing pins to strike the paper sheet directly. Then, either the paper sheet or the printing pins would be broken, thereby interrupting the printing operation.

Such a trouble is not so serious with a printer of a personal computer because an operator usually attends the device, observing the printing condition, and replacing an inked ribbon in use without delay when printed characters become thinner and less distinct. On the contrary, with a general purpose computer, the operator does not always observe printing conditions. In addition, a great amount of printing is carried out at a higher speed. When a trouble such as that described above happens to occur, work efficiency of the device would be decreased extensively due to time and expense required to repair the faulty device.

To prevent such a trouble, the printer is provided with means for detecting folds of the inked ribbon, thereby interrupting the operation of the printer. When either the upper or lower detector 10*a* or 10*b* is out of contact with either the upper or lower edge of the inked ribbon 12, the detector 10*a* or 10*b* issues a detection signal, according to which printing is stopped, urging replacement of the inked ribbon 12 by an alarm.

With a conventional dot impact printer, a warning is not issued until the inked ribbon are detected to be folded. Therefore, the printing operation may be carried out under unfavorable conditions for a relatively long period of time.

SUMMARY OF THE INVENTION

It is therefore an object of this invention to provide a dot impact printer in which a timing for replacing a worn inked ribbon can be detected.

According to the invention, there is provided a dot impact printer comprising: a printing means for making printing pins impact perpendicularly on an inked ribbon to form a pattern of dots on a paper sheet; a ribbon feeder for feeding sequentially the inked ribbon to the printing means; a sensor for detecting bending of the inked ribbon in a widthwise central portion thereof, the sensor having a contacting member which is biased to be perpendicular against a surface of the inked ribbon and which is in contact with the widthwise central portion of the inked ribbon; and a control means for sending control signals to the printing means and the ribbon feeder according to a bending amount signal from the sensor so as to interrupt printing and feeding operations.

The dot impact printer may further include an alarm for alerting replacement of the inked ribbon according to the slack amount signal from the sensor.

With the dot impact printer having the above arrangement, the printing heads impact on the inked ribbon. Therefore, the inked ribbon would become loose and bend at its central portion. The amount of bending is detected by a detector. When the amount of bending reaches a predetermined value, a control unit finds the inked ribbon unusable, interrupting ribbon feeding. Further, the control unit causes the alarm to alert that the inked ribbon should be replaced.

As described above, when the central portion of the inked ribbon bends to a degree beyond the predetermined amount, unusability of the inked ribbon will be detected. Therefore it is possible to prevent the printing from being continued under unfavorable conditions for a long period of time.

DETAILED DESCRIPTION

A preferred embodiment of this invention will now be described with reference to accompanying drawings.

Figure 1:
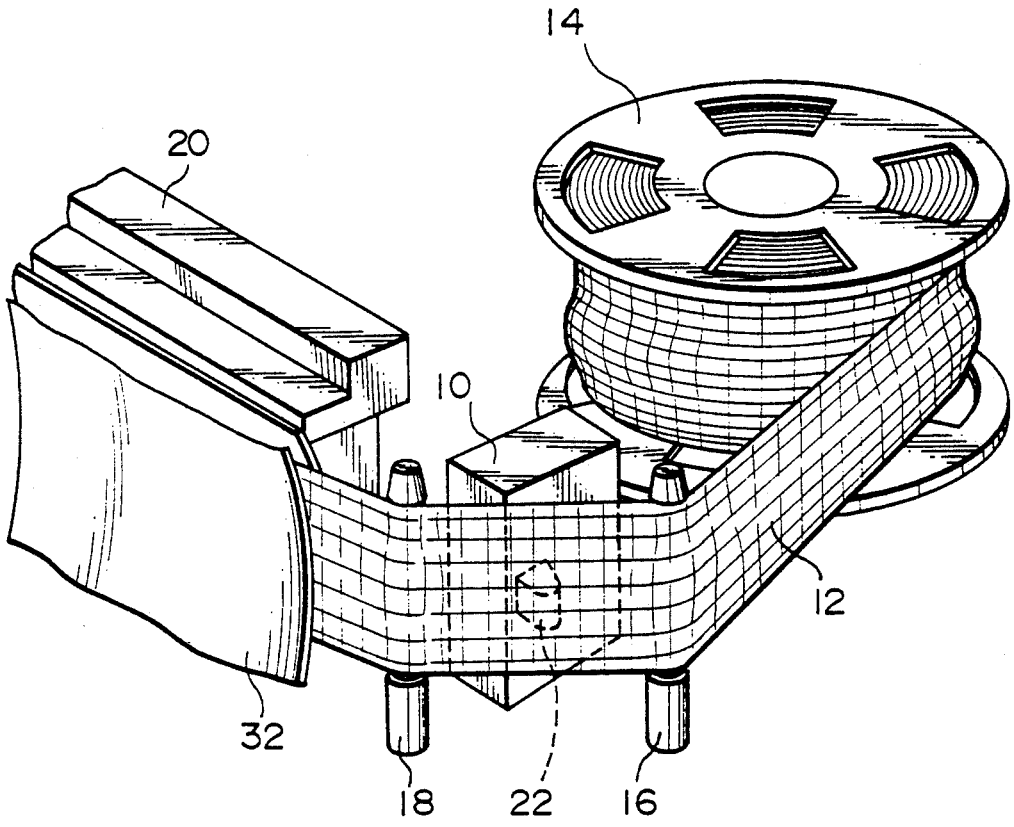
FIG. 1 is a perspective view showing a part of a dot impact printer according to this invention.

FIG. 1 is a perspective view of a ribbon sensor 10 serving as a detecting means. A ribbon 12 of a narrow strip of inked cloth is wound around a pair of spools 14, being guided into a carriage 20 via guide posts 16, 18.

A ribbon sensor 10 is located between the guide posts 16 and 18, including a contacting member 22, which is usually in contact with the widthwise central portion of the inked ribbon 12, being projectable toward the inked ribbon 12 when the inked ribbon becomes untouchable.

Figure 9:
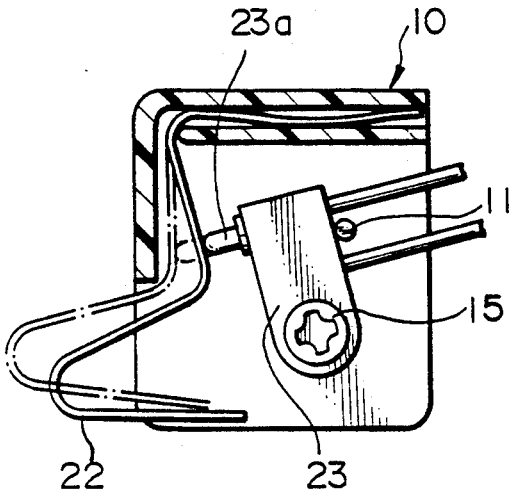
FIG. 9 is a cross sectional view of a ribbon sensor.
Figure 10:
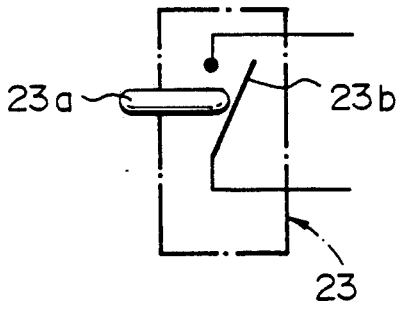
FIG. 10 shows a contact in a switch box.

As shown in FIG. 9, the ribbon sensor 10 has a switch box 23 for housing a switch 23*a* which is connectable with the contacting member 22. The switch box 23 is positioned by a projection 11 extending from the ribbon sensor 10, being fastened by a screw 15. The switch 23*a* is movable together with the contacting member 22. When the contacting member 22 projects to a predetermined extent, the switch 23 closes a contact 23*b* to make an output signal of the ribbon sensor 10 an "H" level.

The ribbon sensor 10 is connected to a CPU 24 as a control unit. A motor 26 is connected to the CPU 24 so as to feed the ribbon 12 to the carriage 20 gradually by rotating the spools 14, 14.

Figure 3:
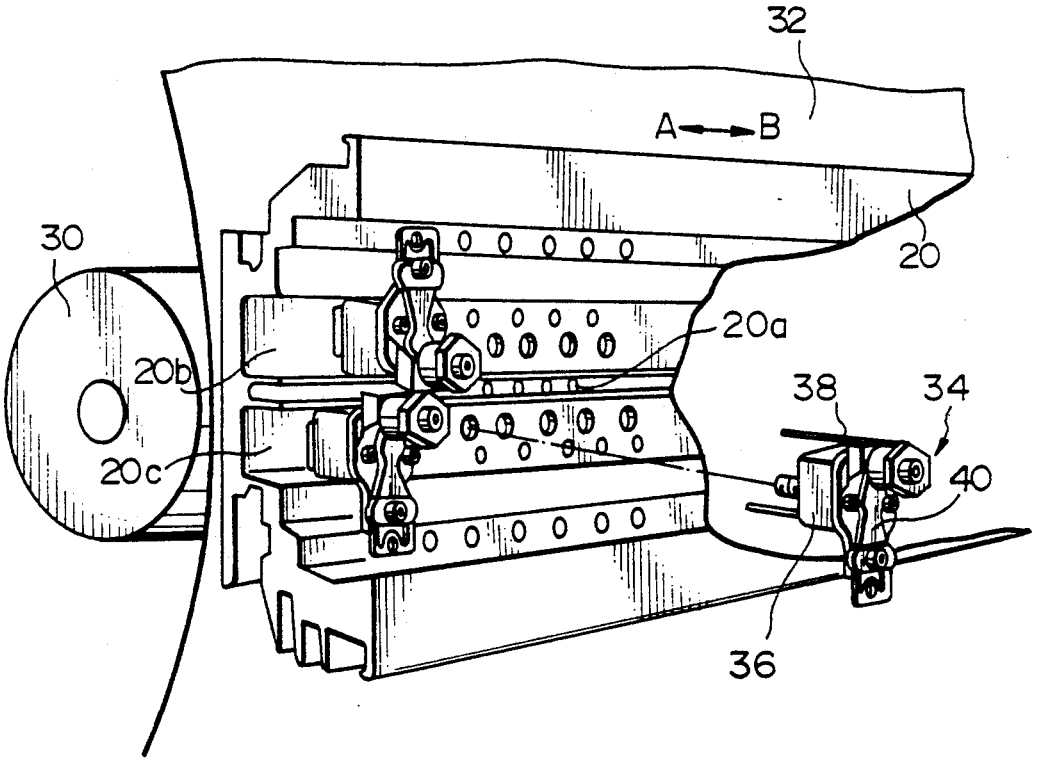
FIG. 3 shows the manner for installing printing heads.

A paper sheet 32 is wound around a platen 30 as shown in FIG. 3. The carriage 20 is supported against the platen 30 so as to be reciprocative in the directions shown by arrows A and B. Reciprocation of the carriage 20 permits characters to be formed in dot patterns on the paper sheet.

Openings 20*a* are arranged linearly at a substantially central portion of the carriage 20 so as to receive the printing pins. A pair each of printing heads 34 are disposed in grooves 20*b*, 20*c* in confronting relation at portions above and under the openings 20*a*.

Each of the printing heads 34 includes an electromagnetic actuator 36 and a printing spring 40 for holding a printing pin 38.

To perform printing, a pair of the spools 14, 14 are rotated by the motor 26 in a predetermined direction to a predetermined extent so that the inked ribbon 12 is forwarded toward the carriage 20 to predetermined extent.

In a plurality of printing heads 34 in the carriage 20, electromagnetic actuators 36 attract printing springs 40 so as to drive printing pins 38. The printing pins 38 impact on and push the inked ribbon 12 to the paper sheet 32, forming patterns of dots on the paper sheet 32.

Figure 4:
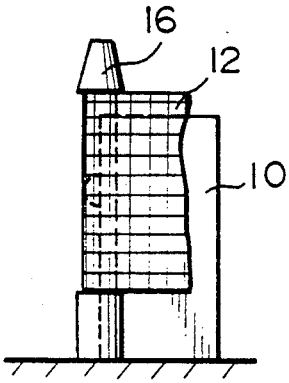
FIG. 4 to FIG. 7 show operation of a ribbon sensor for the dot impact printer of this invention.
Figure 5:
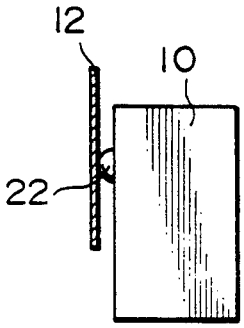

During printing, the contacting member 22 of the ribbon sensor 10 is in contact with the inked ribbon 12, detecting whether or not the inked ribbon 12 is slack at its central portion, as shown in FIGS. 4 and 5.

Figure 6:
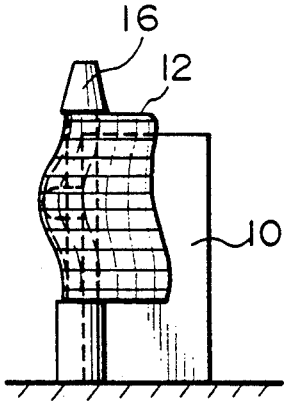

As ink in the ribbon 12 is consumed by use for a long period of time, the cloth of the inked ribbon 12 is crushed by the printing pins 38 which impacts on the paper sheet 32 on the platen 30. Therefore the ribbon 12 will become slack at its central portion compared with at its opposite side edges as shown in FIG. 6.

Figure 7:
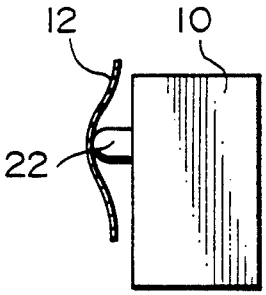
Figure 8A:
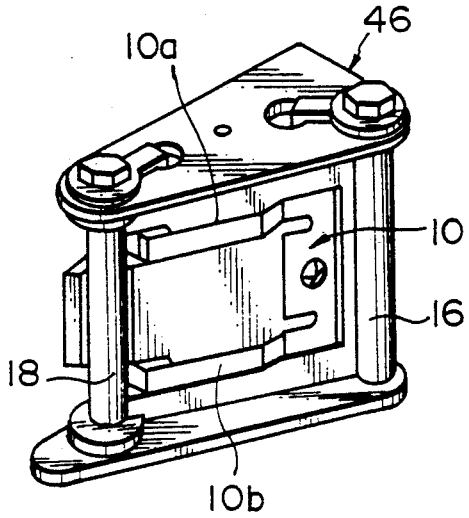
FIG. 8A PRIOR ART
FIGS. 8(A) to 8(C) are perspective views of printing heads of prior art dot impact printers.
Figure 8B:
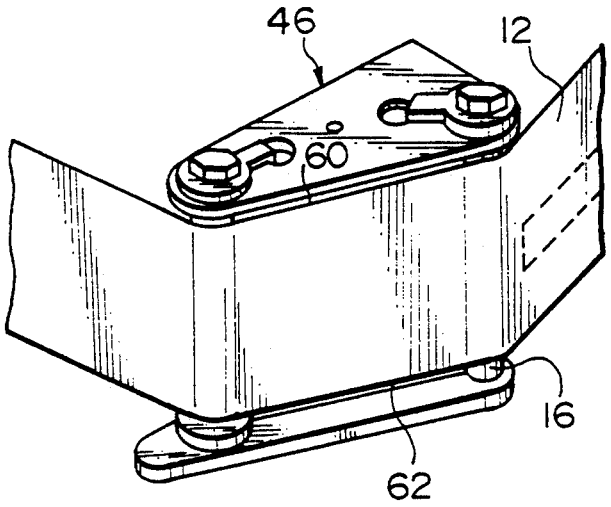
FIG. 8B PRIOR ART
Figure 8C:
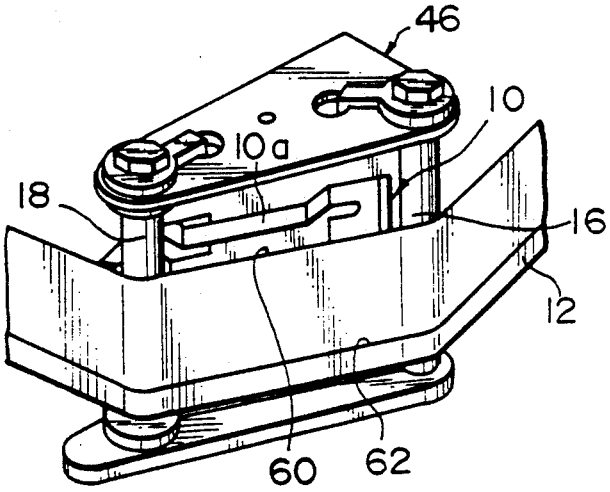
FIG. 8C PRIOR ART

Then the contacting member 22 of the ribbon sensor 10 advances toward the central portion of the ribbon 12 as shown in FIG. 7, projecting to come into contact with the slack central portion of the ribbon 12. When the contact member 22 projects to a predetermined extent, the ribbon sensor 10 emits an output signal of "H" level.

Upon receiving the output signal of "H" level from the ribbon sensor 10, the CPU 24 finds the inked ribbon 12 unusable, stopping the motor 26 so as to interrupt the ribbon feeding, and making the printing heads 34 inoperative.

Figure 2A:
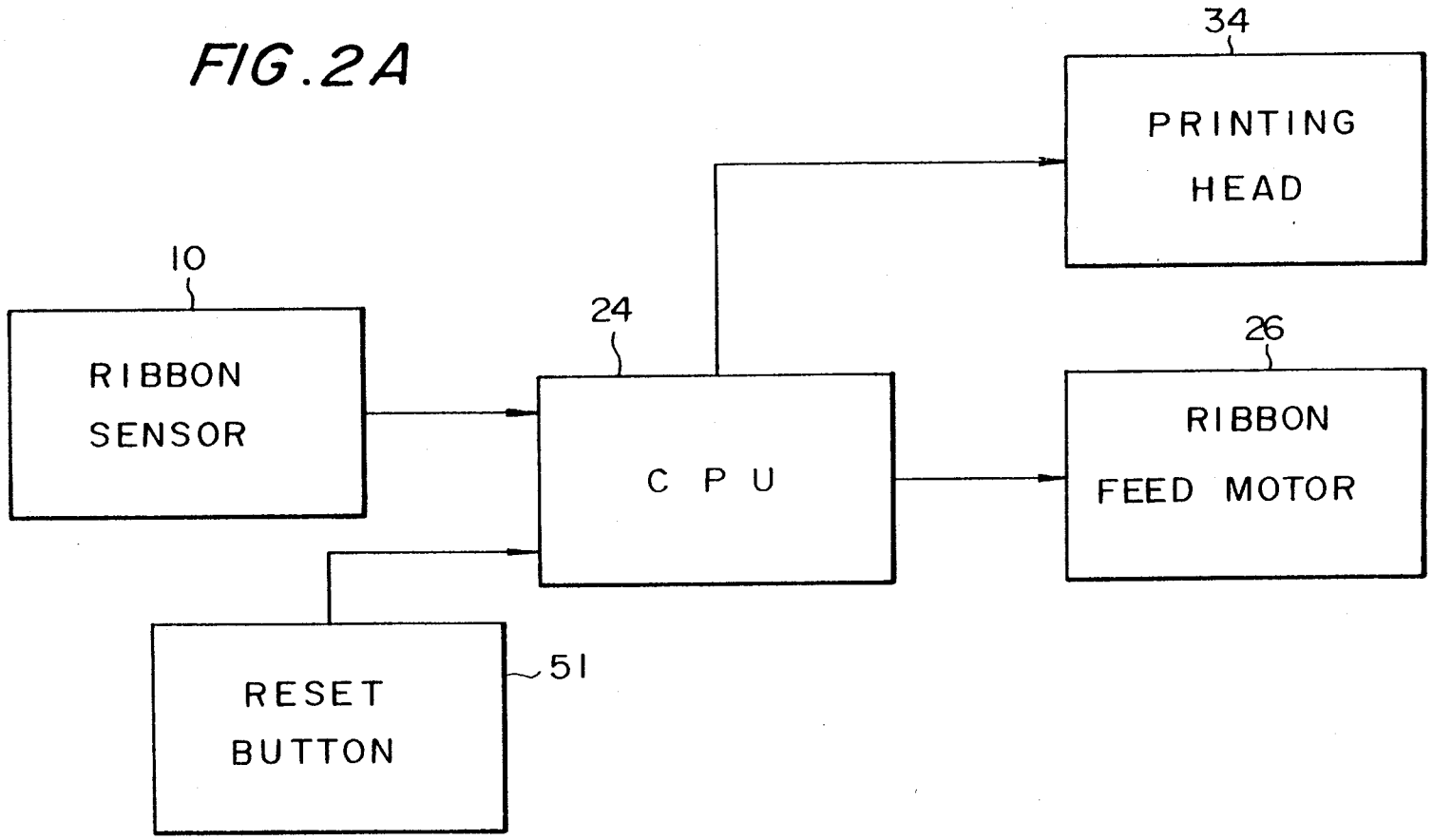
FIGS. 2(A) and 2(B) are block diagrams of the dot impact printer of FIG. 1.
Figure 2B:
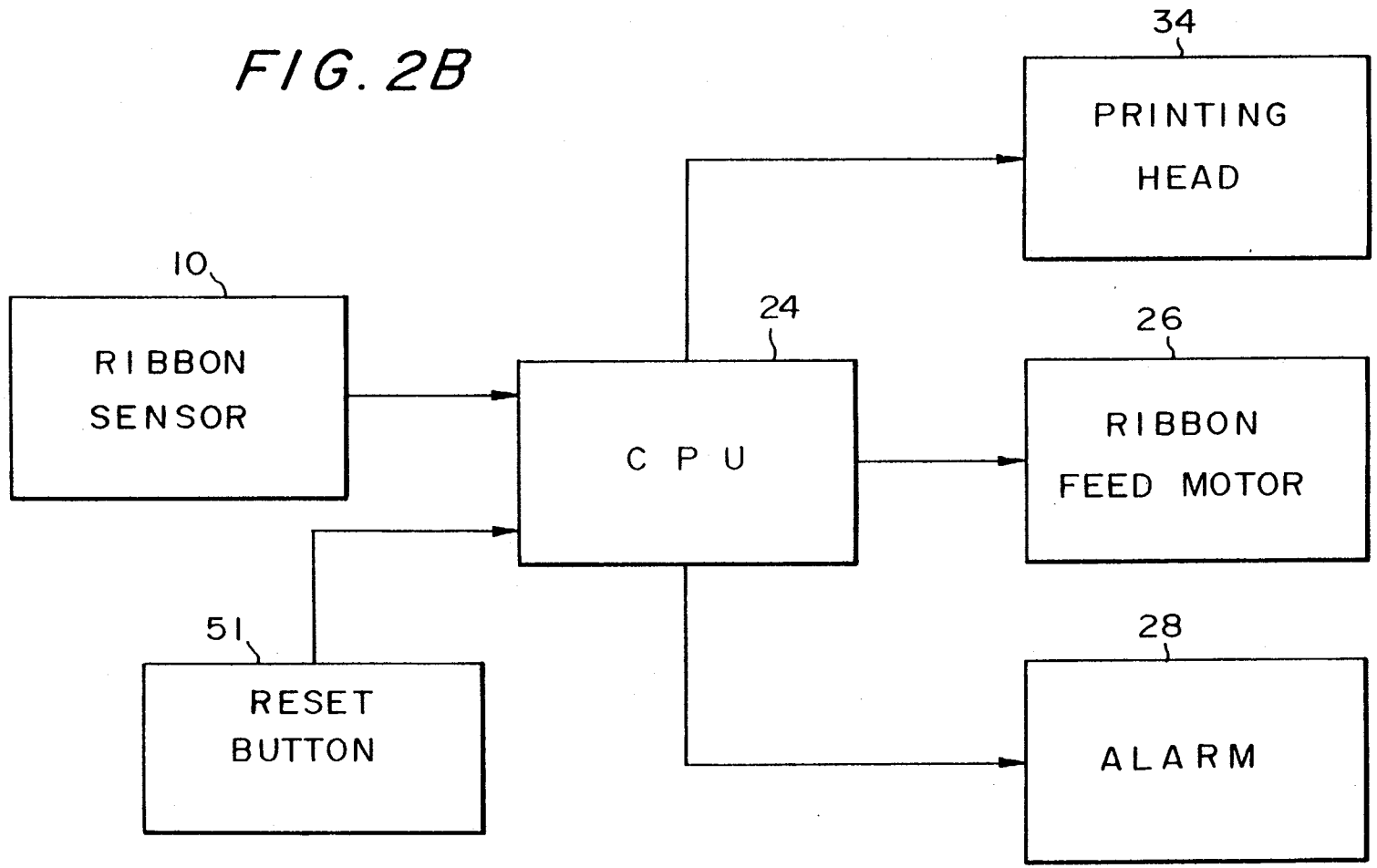

An alarm 28 may be connected to the CPU 24 so as to urge replacement of the ribbon as shown in FIG. 2B.

Then the operator replaces the existing ribbon 12 with a fresh one, turning on a reset button 51 connected to the CPU 24, which enables the dot impact printer to resume printing.

We claim:

1. A dot impact printer of a type including an inked ribbon, said printer comprising:

a printing means for impacting printing pins perpendicularly on a widthwise central portion of said inked ribbon to form a pattern of dots on a sheet of paper; said impacting eventually resulting in said widthwise central portion being crushed and slackened, a ribbon feeder for continuously feeding said inked ribbon to said printing means;

means for detecting the slackening of said width wise central portion including guide elements providing a straight path for said ribbon between said guide elements;

a sensor located between said guide elements for contacting and detecting slackening of only the widthwise central portion of said inked ribbon which has been crushed by impact of said printing pins upon said ribbon and means for generating an alarm signal responsive to an amount of slack in said widthwise central portion which exceeds a predetermined amount, said sensor having a contact member being biased to be perpendicular against a surface of said inked ribbon and in contact with only the widthwise central portion of said inked ribbon; and a control means for sending a control signal to said printing means and said ribbon feeder in response to said alarm signal from said sensor to interrupt printing and feeding operations.

2. A dot impact printer according to claim 1, further including an alarm for alternating replacement of said inked ribbon in response to the alarm signal from said sensor.

* * * * *

UNITED STATES PATENT AND TRADEMARK OFFICE

CERTIFICATE OF CORRECTION

PATENT NO. : 5,180,238

DATED : January 19, 1993

INVENTOR(S) : Hiromi Hibino et al.

It is certified that error appears in the above-identified patent and that said Letters Patent is hereby corrected as shown below:

On the title page:

Column [75] Inventors: Change "Hiromi Hibino; Kazumi Hasegawa both of Tokyo; Koujiro Nishida, Coburg Kouzou Abe, Tokyo; Toshio Kurihara, Tokorozawa all of Japan" to --Hiromi Hibino, Kazumi Hasegawa, both of Tokyo Japan; Koujiro Nishida, Coburg, German Kouzou Abe, Tokyo, Japan; Toshio Kurihara, Tokorozawa, Japan--

Signed and Sealed this

Second Day of November, 1993

*Attest:*

Bruce Lehman

BRUCE LEHMAN

*Attesting Officer*

*Commissioner of Patents and Trademarks*